US008553388B2

(12) United States Patent
Easwaran

(10) Patent No.: US 8,553,388 B2
(45) Date of Patent: Oct. 8, 2013

(54) ELECTRONIC DEVICE FOR CONTROLLING A CURRENT

(75) Inventor: Sri Navaneethakrishnan Easwaran, Freising (DE)

(73) Assignee: Texas Instruments Deutchsland GmbH, Freising (DE)

( * ) Notice: Subject to any disclaimer, the term of this patent is extended or adjusted under 35 U.S.C. 154(b) by 422 days.

(21) Appl. No.: 13/039,030

(22) Filed: Mar. 2, 2011

(65) Prior Publication Data

US 2011/0216468 A1 Sep. 8, 2011

(30) Foreign Application Priority Data

Mar. 4, 2010 (DE) ..... 10 2010 010 103

(51) Int. Cl.
*F23Q 7/00* (2006.01)
*F23Q 21/00* (2006.01)
*G01V 1/06* (2006.01)
*H05B 43/02* (2006.01)

(52) U.S. Cl.
USPC ..... 361/248

(58) Field of Classification Search
USPC ..... 361/93.1, 93.9, 247, 248, 251; 307/10.1
See application file for complete search history.

(56) References Cited

U.S. PATENT DOCUMENTS

| | | | | |
|---|---|---|---|---|
| 4,675,561 | A * | 6/1987 | Bowers | 327/382 |
| 5,081,379 | A * | 1/1992 | Korteling | 327/50 |
| 6,157,246 | A * | 12/2000 | Saitou et al. | 327/540 |
| 7,142,407 | B2 * | 11/2006 | Sibrai | 361/247 |
| 7,626,792 | B2 * | 12/2009 | Mitsuda | 361/93.1 |
| 2005/0225925 | A1 * | 10/2005 | Sibrai | 361/247 |
| 2007/0008671 | A1 * | 1/2007 | Picaud et al. | 361/93.1 |
| 2007/0171590 | A1 * | 7/2007 | Nagata et al. | 361/93.1 |
| 2010/0315750 | A1 * | 12/2010 | Maher et al. | 361/93.1 |

* cited by examiner

*Primary Examiner* — Rexford Barnie
*Assistant Examiner* — Christopher Clark
(74) *Attorney, Agent, or Firm* — Alan A. R. Cooper; W. James Brady, III; Frederick J. Telecky, Jr.

(57) ABSTRACT

An electronic device is provided for controlling a current. The electronic device includes a first MOS transistor coupled with a gate to a common gate node, with a source to ground and with a drain to a pin so as to receive from the pin a current to be controlled. There is a second MOS transistor coupled with a gate to the common gate node, with a source to ground and with a drain so as to receive a reference current controlled by a control loop. There is a first resistor coupled between the common gate node and ground.

14 Claims, 4 Drawing Sheets

ELECTRONIC DEVICE FOR CONTROLLING A CURRENT

CROSS-REFERENCE TO RELATED APPLICATIONS

This application is claims priority from German Patent Application No. 10 2010 010 103.6, filed Mar. 4, 2010, which is hereby incorporated by reference for all purposes.

TECHNICAL FIELD

The invention relates to an electronic device for controlling a current, and more specifically to an electronic device for controlling and limiting a current through a squib in an unpowered and powered state of the electronic device

BACKGROUND

Squib driver circuits provide regulated currents in order to ignite the squib and deploy the airbag for passenger safety. The squib is a pyrotechnic element which ignites when a certain amount of energy is provided. In FIG. 1, an example of a typical squib driver circuit 100 can be seen. This driver circuit 100 is generally an integrated circuit or (IC) having an on chip high side power MOSFET Q1 and a low side power MOSFET Q2 that are respectively driven by drivers 102-1 and 102-2. The squib 104 is coupled between two pins Zx and ZMx that pin VZx (which is typically coupled to a power supply) can provide a current (through the high side power MOSFET Q1 and pin Zx) to the squib 104. Squib 104 is then coupled to ground through pin ZMx and the low side power MOSFET Q2. A generally constant current pulse for a time Δt is required in order to ignite the squib 102, and the energy in the squib can be calculated as follows:

$$\text{Energy} \approx I^2 * R * \Delta t \quad (1)$$

The amount of energy indicated in equation (1) is provided to the squib 104 by activating the high side power MOSFET Q1 and the low side power MOSFET Q2 at the same time. However, it is undesirable ignited the squib 104 by or in response to any fault condition (i.e., a short from battery 106 as shown the example of FIG. 2).

Turning now to FIG. 3, a conventional squib driving circuit 300 (which is typically an IC) that is configured to limit the current in the powered and unpowered states. Current limiting is generally achieved by comparing the voltage across a sense resistor R2 with a reference voltage generated by a reference resistor R1 and a current source 312. The current limit $I_{limit}$ is then given by the following equation:

$$I_{limit} \approx \left(\frac{R_1}{R_2}\right) * I_{ref} \quad (2)$$

The current limiter 304 performs the current limiting as long as there is enough power for amplifier 310. When the current through the squib 104 exceeds that the current limit $I_{limit}$ the amplifier 310 deactivates or turns off transistor Q3. Additionally, there is a surge current controller 302 (which uses fault mode sensing circuitry 308 and surge current limiter 306 that generally ensures that the transistor Q3 is turned off quickly to limit the energy in the squib 104). Node V0, however, is a high impedance node, which makes it rather difficult to achieve stable operation, in particular for the typically wide range of resistive, inductive or capacitive loads. In order to stabilize the IC 300, the pole-zero compensation network including resistors RZ and RZ1 and capacitors CC and CC1 at the output of the amplifier 310 becomes more complex and requires more area. This increases the total costs of IC 300, while the potential instability remains an issue. If the RLC-network of the squib 104 (i.e., resistor RS, capacitor CS, and inductor LS) provides only weak damping (i.e., R<1Ω, L>70 μH and C<10 nF) large signal current oscillations may occur. This results in an unstable behavior of the circuit. Furthermore, if the current limiter 304 (including the amplifier 310) does not operate (due to an unpowered state) the Miller capacitance between gate and drain of the transistor Q3 may not be discharged when pin Zx is shorted to the battery (i.e., 106), which an undesirably deploy the squib 104.

SUMMARY

It is an object of the invention to provide an electronic device for limiting a current, in particular for limiting a current through a squib, which provides an improved stability and effectively limits a current through the squib even if the electronic device is not supplied with a power and any of the connections to the squib are shorted to a power supply level.

According to an aspect of the invention, an electronic device for controlling a current is provided. The electronic device comprises a first MOS transistor which is coupled with a gate to a common gate node, with a source to ground and with a drain to a pin so as to receive from the pin a current to be controlled. The electronic device further comprises a second MOS transistor with a gate to the common gate node, with a source to ground and with a drain so as to receive a reference current controlled by a control loop. A first transistor may then be coupled between the common gate node and ground.

This provides that the node at the gate of the first transistor is not a high impedance node. Even in an unpowered state of the electronic device, the control gate of the first resistor can discharge through the first resistor to ground. The first resistor provides a passive pull down path for the first MOSFET, which corresponds to the low side MOSFET LS_FET in FIGS. 1 to 3. The gate-source voltage of the MOSFET may then not exceed the threshold voltage level thereby avoiding any inadvertent activation of the first transistor. This prevents that the squib is deployed. Any pin (as for example pin Zx in FIGS. 1 to 3) could be shorted to the battery, even in the unpowered state of the electronic device, and the common gate node will be discharged through the first resistor.

According to another aspect of the invention, the control loop may comprise an operational amplifier which is coupled with a positive input to the drain of the first MOS transistor, with an inverted input to the drain of the second MOS transistor and with an output to a gate of a third MOS transistor. The third MOS transistor may then be coupled with a source to the drain of the second MOS transistor and with a drain to the power supply. According to this aspect a control loop is implemented, which includes an operational amplifier and a control mechanism in order to regulate the current through the second MOS transistor. Due to the fact that the gates of the first MOS transistor and the second MOS transistor are coupled together at the common gate node, the current through the channel of the second MOS transistor is mirrored to the first MOS transistor and thereby limits the current to be controlled during normal operation.

In another aspect of the invention, a diode may be coupled between the common gate node and the first resistor. Furthermore, a second resistor may be coupled with one side to the first resistor and with the other side to power supply. The first resistor and the second resistor may then form a resistive divider between power supply voltage level and ground. The diode may then be coupled between the common gate node to which the gates of the first MOS transistor and the second MOS transistor are coupled and the node between the first resistor and the second resistor. This aspect of the invention provides that the diode is reverse biased as long as a sufficiently high power supply voltage level is present. However if the power supply level drops below a certain value, the diode is forward biased and the common gate node can be discharged through the diode and the first resistor. The diode may than be forward biased in an unpowered state of the electronic device in order to conduct current. In a powered state of the electronic device, the diode does not have an impact on the electronic device in terms of accuracy or gain of the control loop.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF DRAWINGS

For a more complete understanding of the present invention, and the advantages thereof, reference is now made to the following descriptions taken in conjunction with the accompanying drawings, in which.

DETAILED DESCRIPTION OF EMBODIMENTS

Figure 1:
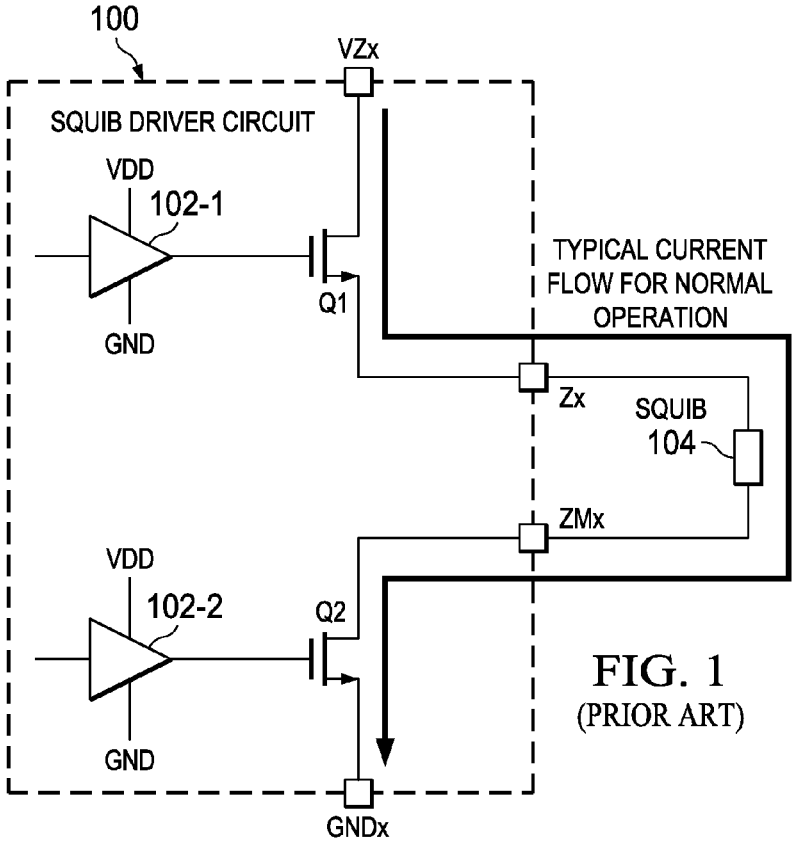
FIG. 1 (PRIOR ART)
FIG. 1 is an example of a conventional squib driver circuit.
Figure 2:
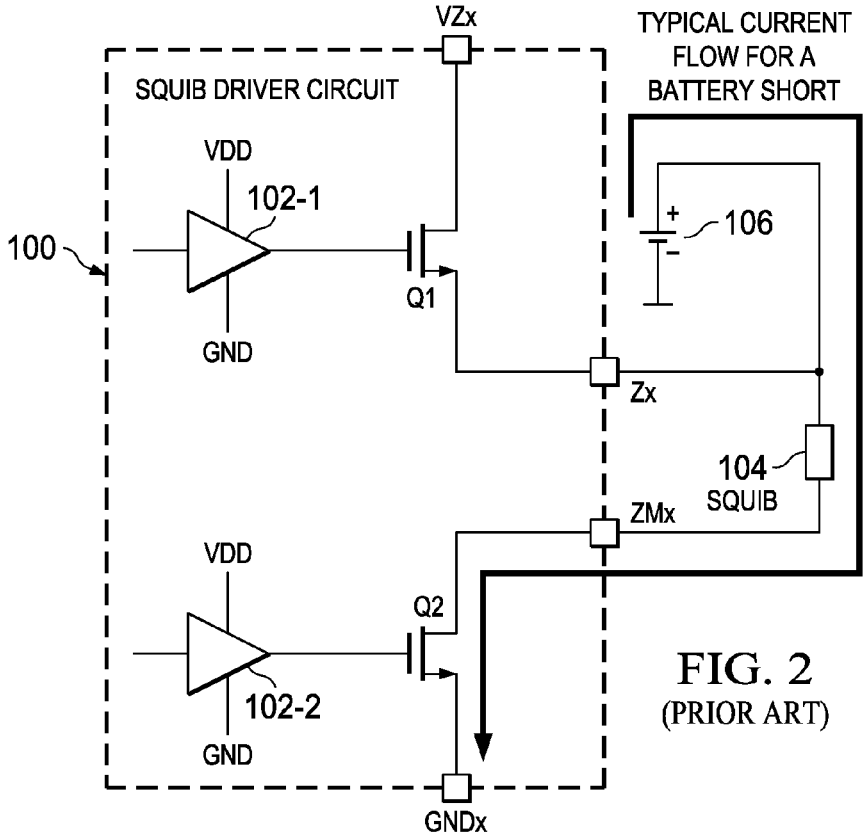
FIG. 2 (PRIOR ART)
FIG. 2 is an example of the squib driver circuit of FIG. 1 during a fault condition.
Figure 3:
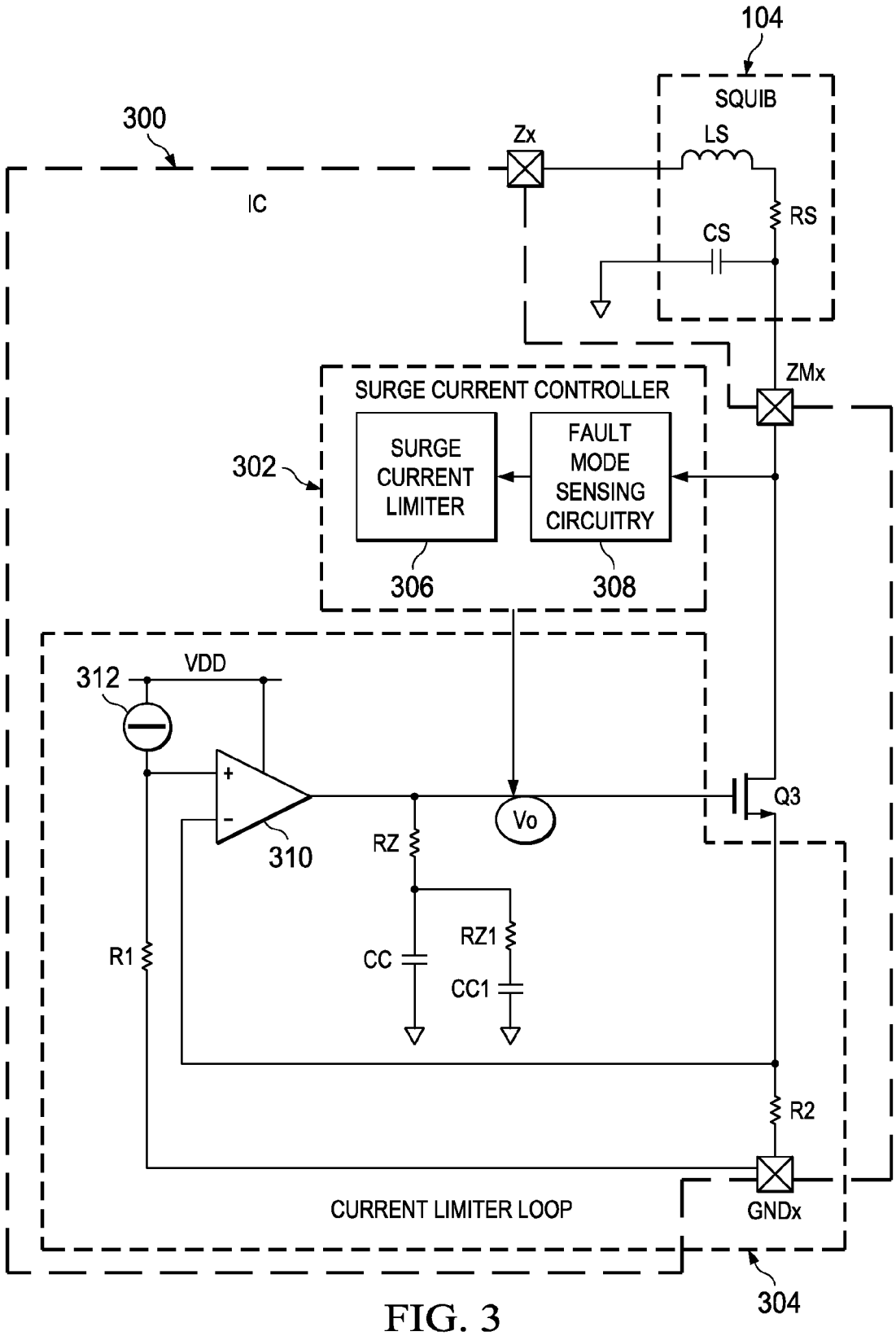
FIG. 3 (PRIOR ART)
FIG. 3 is an example of a portion of a conventional squib driver circuit that includes a current limiter and surge current controller.

Refer now to the drawings wherein depicted elements are, for the sake of clarity, not necessarily shown to scale and wherein like or similar elements are designated by the same reference numeral through the several views.

Figure 4:
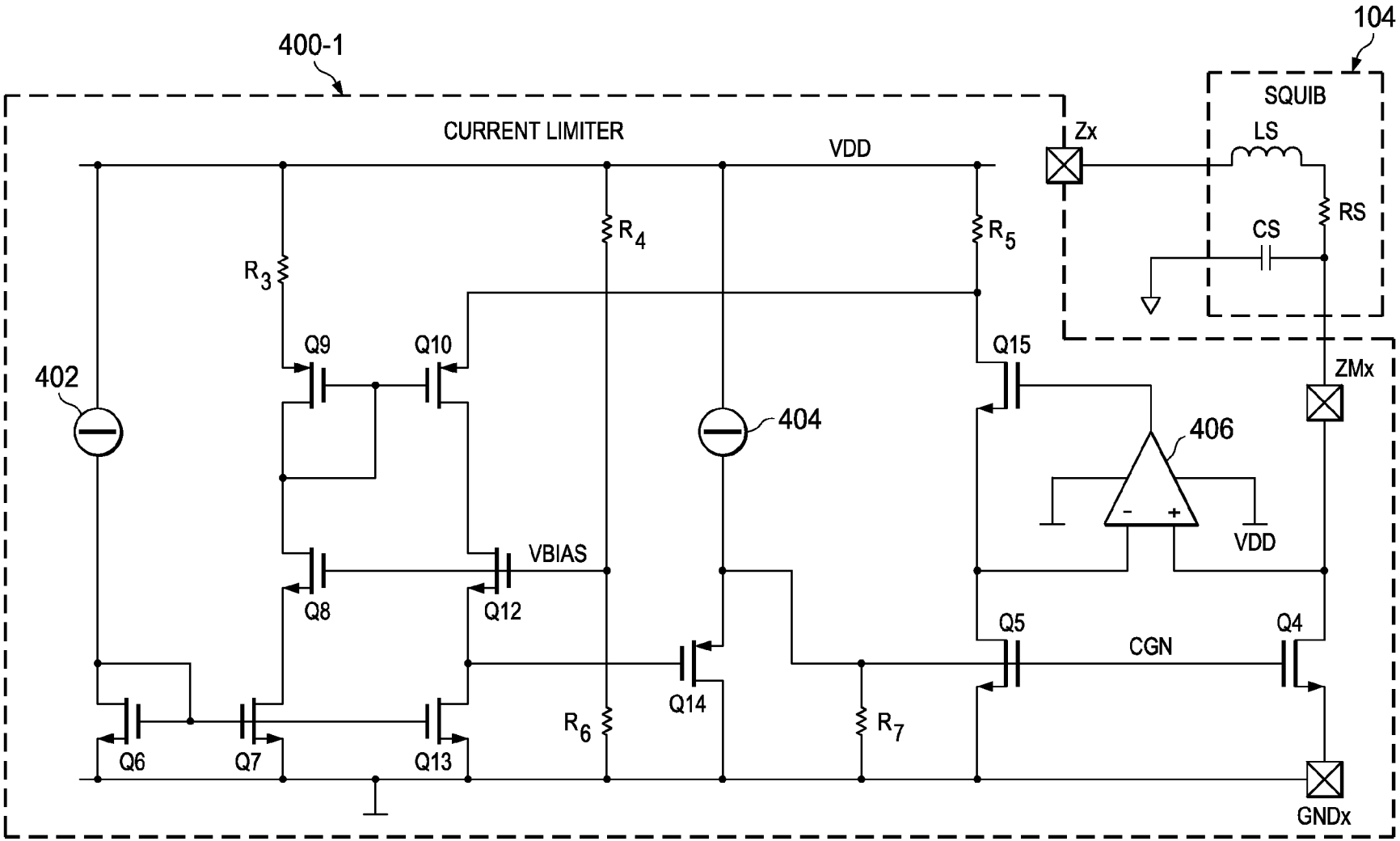
FIGS. 4 and 5 are examples of portions of squib driver circuits in accordance with a preferred embodiment of the present invention.

Turning to FIG. 4, an example of a current limiter 400-1 for a squib driver circuit can be seen. Similar to the squib driver circuit 100, the squib driver circuit associated with FIG. 4 includes FETs Q1 and Q2 and drivers 102-1 and 102-1. The squib 104 is to be coupled between pins Zx and ZMx, and a current can be fed to pin Zx so as to flow through the squib 104 to pin ZMx. This current can the flow through a transistor Q4 to ground pin GNDx.

In FIG. 4, a current limiter 400-1 is provided to limit the current through squib 104. Transistor Q4 is coupled with a drain to pin ZMx in order to receive the current to the squib 104 which is to be controlled. The source of the first transistor Q4 is coupled to ground at ground pin GNDx. The gate of the first transistor Q4 is coupled to a common gate node CGN. There is a second MOS transistor Q5 the source of which is also coupled to ground GNDx. The gate of the second transistor Q5 is coupled to the common gate node CGN. The drain of the second transistor Q5 is coupled to the source of a third transistor Q15. The third transistor Q15 receives at its control gate the output signal of an operational amplifier (operational transconductance amplifier) 406. The positive input of the amplifier 406 is coupled to the drain of the first transistor Q4. The inverted input of the amplifier 406 is coupled to the drain of the second transistor Q5. The drain of the third transistor Q15 is coupled to a resistor R5 and the other side of the resistor R5 is coupled to power supply voltage VDD. A resistor R7 is coupled to the common gate node CGN. The resistor R7 provides that the gates of the first transistor Q4 and the second transistor Q5 are pulled down. The common gate node is also coupled to a node between a reference current source 404 and another MOS transistor Q14. The MOS transistor Q14 is coupled as a source follower stage. Under normal operating conditions, the voltage drop across R7 is high enough in order to open the first transistor Q4 and the second transistor Q5 sufficiently. There is another reference current source IREF coupled between the supply voltage level VDD and a drain of a transistor Q6. The source of transistor Q6 is coupled to ground. The control gate of transistor Q6 is coupled to the drain so as to implement a current mirror together with transistor Q7.

Therefore, the current from current source IREF is mirrored into transistor Q7 and flows through transistor Q8 and Q9 as well as resistor R3. Transistor Q9 is also diode coupled and forms a current mirror together with transistor Q10. This provides that the current through the branch R3, Q9, Q8 and Q7 is mirrored into the branch comprising Q10, R5, Q12 and Q13. There is a resistive voltage divider comprising resistor R4 and resistor R6, which is coupled between the supply voltage level VDD and ground GNDx. The node between resistor R4 and R6 is coupled to the gate of transistor Q12. Dependent on the voltage level on the gate of transistor Q14, the current from current source 404 either flows through transistor Q14 or through resistor R7. If the current through resistor R7 increases, the voltage level at common gate node CGN increases and transistors Q5 and Q4 are turned on. The amplifier 406, transistor Q15 and resistor R5 provide in the control loop configuration that the voltage levels at the drains of Q5 and Q4 are equal.

The amplifier 406 is used to equalize the drain source voltages of transistors Q4 and Q5 in order to sense and control the current through Q4 accurately. Advantageously, the second transistor Q5 can carry M times less current than the first transistor Q4 (meaning that the ratio of the size of transistor Q5 to transistor Q4 is M:1). The following equation may apply:

$$I_{limit} \approx M * \left(\frac{R_1}{R_2}\right) * I_{ref} \tag{3}$$

The maximum current through the first transistor Q4 will then be $I_{limit}$. Resistors R3 and R5 should be well matched. However, resistor R3 may be greater than resistor R5 (R3>R5). Therefore, the quotient R3/R5 can be 1. The current limitation loop formed by the transistors Q6-Q13 followed by the source follower stage Q14 controls the gate of transistors Q5 and Q4 in order to regulate and limit the current through transistor Q4 if transistor Q4 would see a sudden increase in its current. The resistor R7 provides a passive pull down for the low side power MOSFET Q4 so that the gate source voltage may not exceed the threshold in order to avoid any inadmissible switching of the transistor Q4 in order to avoid undesired deployment of the squib.

However the circuitry shown in FIG. 4 still has three active stages for controlling the current. There is the amplifier 406, a control mechanism formed out of transistors Q6-Q13 and the transistor Q14 source follower stage. The source of transistor Q14 drives the gate capacitance of the low side power MOSFET Q4. This configuration in combination with a wide range of possible resistive, inductive and capacitive squib loads (RS, LS, and CS) may still cause instability and provoke undesired oscillations and high current values through the squib. In order to stabilize this circuitry, additional resistors and capacitors may be required in order to improve the phase margin for the stability. This can still increase the chip area.

Figure 5:
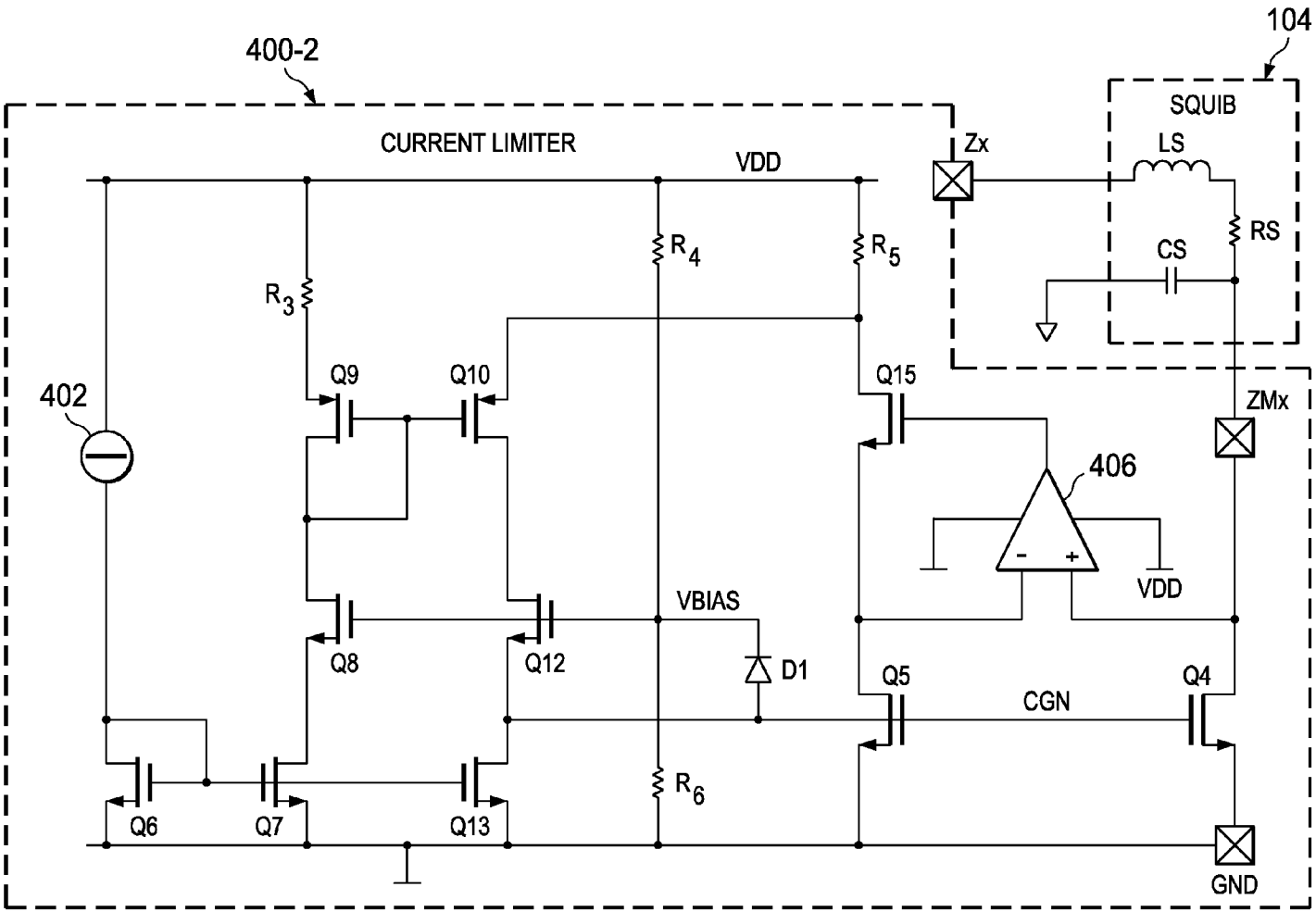

Turning to FIG. 5, another example of a current limiter 400-2 can be seen. The configuration shown in FIG. 5 does not employ the source follower Q14. Instead, a diode D1 is coupled with an anode to the common gate node CGN (i.e., to the gate of transistor Q4 and the gate of transistor Q5) and with a cathode to the resistive voltage divider comprising resistors R4 and R6. The resistor R4 is coupled to the supply voltage level and to node that provides the bias voltage VBIAS. If the power supply voltage level VDD is high enough, the cathode of diode D1 is pulled up and the diode D1 is reverse biased. As a consequence, no current flows from the common gate node CGN to ground. If the supply voltage level VDD drops, the voltage level at node providing the bias voltage VBIAS also drops and eventually, the diode D1 changes from reverse biased mode to forward biased mode. This means that the diode D1 should be forward biased in an unpowered state. In a powered state of the electronic device, it should be reverse biased. This provides that a current can flow from node CGN through diode D1 and resistor R6 to ground. So even if not powered, i.e. the supply voltage level at VDD is zero, node CGN can be discharged through diode D1 and resistor RB. If during a fault condition, a supply voltage level (for example from a battery) is applied to pin Zx, it can be prevented that the common gate node CGN is charged through the parasitic drain gate capacitance of transistor Q4 as the common gate node CGN can be discharged through diode D1 and resistor RB. As the source follower Q14 (shown in FIG. 4) is removed, the circuit is more stable and the output of the main regulating loop formed by Q9, Q10, Q7 to Q12 may drive the gate of the low side MOSFET Q4 directly. This provides that the stability for load damping situations is improved. On-chip capacitors and resistors for compensation may be avoided. A resistor, as for example R7 shown in FIG. 4, reduces the output impedance which will impact the open loop gain of this control loop. Removing the resistor R7 from node CGN may impact the control accuracy of the surge current through Q4 in the unpowered state and it may take longer to discharge the Miller capacitance of Q4 which may deploy the squib. However, the diode D1 between the gate and source of transistor Q12 does not influence the performance of the current limitation during normal operation but limits the surge current by forward biasing the diode D1 and discharging the gate of Q4 through resistor R6 in the unpowered state. The stability of the current limitation loop in a powered state is improved for a wide range of RS, LS, and CS loads of the squib 106 compared with conventional solutions. The circuit shown in FIG. 5 is area efficient and small since no additional area is required for compensation capacitors and resistors, and the source follower as a separate control mechanism during the unpowered state is avoided.

Having thus described the invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the invention may be employed without a corresponding use of the other features. Accordingly, it is appropriate that the appended claims be construed broadly and in a manner consistent with the scope of the invention.

The invention claimed is:

1. An apparatus comprising:
- a squib pin;
- a ground pin;
- a squib coupled to the squib pin;
- a control loop;
- a first MOS transistor that is coupled between the squib pin and the ground pin, wherein the first transistor is controlled by the control loop;
- a resistor that is coupled to the control loop;
- a second MOS transistor that is coupled to the resistor;
- a third MOS transistor that is coupled between the second transistor and the ground pin, wherein the third MOS transistor is controlled by the control loop; and
- an amplifier that is coupled to the squib pin and a node between the second transistor and the third transistor and that is coupled to the gate of the second transistor, wherein the amplifier equalizes the drain-source voltages of first and third MOS transistors.

2. The apparatus of claim 1, wherein the control loop further comprises:
- a current source;
- a current mirroring circuit that is coupled to the current source and the resistor;
- a voltage divider that is coupled to the current mirroring circuit; and
- a control circuit that is coupled to the current mirroring circuit and the gates of the first and third MOS transistors.

3. The apparatus of claim 2, wherein the resistor further comprises a first resistor, and wherein the current mirroring circuit further comprises:
- a first current mirror that is coupled to the current source;
- a plurality of bias transistors that are coupled to the first current mirror and the voltage divider;
- a second current mirror that is coupled to the plurality of bias transistors and the first resistor; and
- a second resistor that is coupled to the second current mirror.

4. The apparatus of claim 3, wherein the first and second MOS transistors are substantially matched.

5. The apparatus of claim 4, wherein ratio of the size of the third MOS transistor to the first transistor is M:1.

6. The apparatus of claim 5, wherein the current source further comprises a first current source, and wherein the control circuit further comprises:
- a second current source; and
- a source-follower that is coupled to the second current source, the first current mirror, and the gates of the first and third MOS transistors.

7. The apparatus of claim 5, wherein the control circuit further comprises a diode that is coupled to the voltage divider, the first current mirror and the gates of the first and third MOS transistors.

8. An apparatus comprising:
- a squib pin;
- a ground pin;
- a squib that is coupled to the squib pin;
- a capacitor coupled to the squib pin;

a control loop;

a first MOS transistor that is coupled between the squib pin and the ground pin, wherein the first transistor is controlled by the control loop;

a resistor that is coupled to the control loop;

a second MOS transistor that is coupled to the resistor;

a third MOS transistor that is coupled between the second transistor and the ground pin, wherein the third MOS transistor is controlled by the control loop; and an amplifier that is coupled to the squib pin and a node between the second transistor and the third transistor and that is coupled to the gate of the second transistor, wherein the amplifier equalizes the drain-source voltages of first and third MOS transistors.

9. The apparatus of claim 8, wherein the control loop further comprises:

a current source;

a current mirroring circuit that is coupled to the current source and the resistor;

a voltage divider that is coupled to the current mirroring circuit; and a control circuit that is coupled to the current mirroring circuit and the gates of the first and third MOS transistors.

10. The apparatus of claim 9, wherein the resistor further comprises a first resistor, and wherein the current mirroring circuit further comprises:

a first current mirror that is coupled to the current source;

a plurality of bias transistors that are coupled to the first current mirror and the voltage divider;

a second current mirror that is coupled to the plurality of bias transistors and the first resistor; and a second resistor that is coupled to the second current mirror.

11. The apparatus of claim 10, wherein the first and second MOS transistors are substantially matched.

12. The apparatus of claim 11, wherein ratio of the size of the third MOS transistor to the first transistor is M:1.

13. The apparatus of claim 12, wherein the current source further comprises a first current source, and wherein the control circuit further comprises:

a second current source; and a source-follower that is coupled to the second current source, the first current mirror, and the gates of the first and third MOS transistors.

14. The apparatus of claim 12, wherein the control circuit further comprises a diode that is coupled to the voltage divider, the first current mirror and the gates of the first and third MOS transistors.

* * * * *